US005531614A

United States Patent [19]

Gallusser et al.

[11] Patent Number: 5,531,614

[45] Date of Patent: Jul. 2, 1996

[54] COMPOSITE CANNED DATA BUS COUPLER CONNECTOR

[75] Inventors: David O. Gallusser, Oneonta; James B. LeBaron; Robert G. Wheeler, both of Sidney, all of N.Y.

[73] Assignee: Amphenol Corporation, Wallingford, Conn.

[21] Appl. No.: 696,962

[22] Filed: May 8, 1991

[51] Int. Cl.[6] ..... H01R 13/648

[52] U.S. Cl. ..... 439/607; 439/931; 439/851

[58] Field of Search ..... 439/851, 607, 439/608, 610, 63, 88, 886, 931, 581; 524/80, 611

[56] References Cited

U.S. PATENT DOCUMENTS

| | | | |
|---|---|---|---|
| 3,391,384 | 7/1968 | Hughes | 439/695 X |
| 3,958,851 | 5/1976 | Evans . | |
| 4,014,849 | 3/1977 | Horn et al. | 524/80 X |
| 4,440,463 | 4/1984 | Gliha, Jr. et al. . | |
| 4,519,665 | 5/1985 | Althouse et al. . | |
| 4,542,437 | 9/1985 | Ellis et al. | 439/607 X |
| 4,623,290 | 11/1986 | Kikuzawa et al. | 411/350 |
| 4,641,902 | 2/1987 | Fusselman . | |
| 4,641,907 | 2/1987 | Althouse et al. . | |
| 4,651,100 | 3/1987 | Janes | 324/338 |
| 4,674,809 | 6/1987 | Hollyday et al. . | |
| 4,684,200 | 8/1987 | Capp | 439/63 X |
| 4,687,615 | 8/1987 | Kondo et al. | 264/557 |
| 4,720,155 | 1/1988 | Schildraut et al. | 439/108 |
| 4,756,695 | 7/1988 | Lane et al. | 439/76 |
| 4,799,893 | 1/1989 | Ogawa et al. | 439/81 X |
| 4,837,251 | 6/1989 | Okey et al. | 523/218 |
| 4,863,330 | 9/1989 | Olez et al. | 411/424 |
| 4,871,412 | 10/1989 | Felix et al. | 156/273 |
| 4,908,169 | 3/1990 | Galic et al. | 264/40.2 |
| 4,946,397 | 8/1990 | Grasser | 439/607 X |
| 4,946,526 | 8/1990 | Petty-Galis et al. | 156/155 |
| 5,032,809 | 7/1991 | Chambers et al. | 439/608 X |

FOREIGN PATENT DOCUMENTS

| | | |
|---|---|---|
| 0241738 | 10/1987 | European Pat. Off. . |
| 0512921 | 11/1992 | European Pat. Off. . |
| 2068654 | 8/1981 | United Kingdom . |
| 2137436 | 10/1984 | United Kingdom . |
| 2163012 | 8/1985 | United Kingdom . |

OTHER PUBLICATIONS

John A. Manson, "Polymeric Composite," McGraw–Hill Encyclopedia of Science & Technology, 6th Edition, 1987, vol. 14.

Robert L. Rapson, "Composite Material," McGraw–Hill Encyclopedia of Science & Technology, 6th Edition, 1987, vol. 4.

*Primary Examiner*—David L. Pirlot

*Attorney, Agent, or Firm*—Bacon & Thomas

[57] ABSTRACT

A data bus coupler includes a plated composite housing and a plurality of twin axial contacts, the shielding portions of each contact being connected to the housing by a conductive insert which serves to retain the contacts in the connector. The coupler also includes a printed circuit board carrying transformers and isolation resistors for providing stub connections to a data bus line.

12 Claims, 5 Drawing Sheets

COMPOSITE CANNED DATA BUS COUPLER CONNECTOR

BACKGROUND OF THE INVENTION

1. Field of the Invention

This invention relates to electrical connectors, and more particularly to a shielded electrical connector including data bus coupling circuitry.

2. Description of Related Art

A data bus coupler is an electrical connector which permits splitting of data signals without attenuation of the signal strength. The data bus typically includes a single, twisted, pair of wires and a cable shield which protects transmitted data from magnetic and electrostatic interference. The coupler typically includes a bus line which connects an input contact to an output contact, and a number of branch or stub contacts tapped into the bus line via transformers. The resulting multiplexed data bus coupler enables the use of smaller and lighter twinaxial cables instead of complicated, heavy and dedicated cabling. Desirable qualities in a data bus coupler are that the coupler be compact, lightweight, electromagnetically sealed, and able to withstand severe environmental conditions.

One such data bus coupler is disclosed in U.S. Pat. No. 4,720,155. The coupler of U.S. Pat. No. 4,720,155 includes a metallic shell, an apertured ground plate to connect the shields of the contacts to the shell, a dielectric contact retention member, and a circuit board which carries a transformer and isolation resistors. The ground plate fits between the main housing and a rear can enclosure which encloses the circuit board.

The coupler disclosed in U.S. Pat. No. 4,720,155 provides a compact and effectively shielded structure. However, for many applications, it would be desirable to reduce even further the weight, number of parts, and size of such a coupler, without reducing its shielding effectiveness.

SUMMARY OF THE INVENTION

It is an objective of the invention to reduce the weight without reducing the strength of prior electrical connectors by providing a housing made of a metal-plated non-metallic composite substrate.

It is also an objective of the invention to accomplish the above objective by providing a lightweight, high strength data bus coupler having a housing and rear can enclosure both made of a metal-plated non-metallic composite substrate.

It is a further objective of the invention to provide a less complex shielded electrical connector in which a ground plane and dielectric contact retention member are replaced by a conductive insert assembly which serves as both a contact retention member and as a ground path between the housing and the contacts.

It is a still further objective of the invention to provide an electrical connector which includes a circuit board on which are mounted the connector contacts and circuit elements such as resistors and transformers arranged to provide an especially compact data bus coupler assembly.

These objectives are achieved, according to a preferred embodiment of the invention, by (1) providing a data bus coupler which includes a housing and rear can enclosure made of metal plated polyetheretherketone (PEEK) reinforced by 45% by weight carbon fibers, (2) providing a conductive insert assembly for a shielded electrical connector which includes integral contact retention structures, and (3) providing an electrical connector in which contact tails are directly terminated to a printed circuit board mounted transversely in respect to a longitudinal axis of the connector.

DETAILED DESCRIPTION OF THE PREFERRED EMBODIMENT

Figure 1:
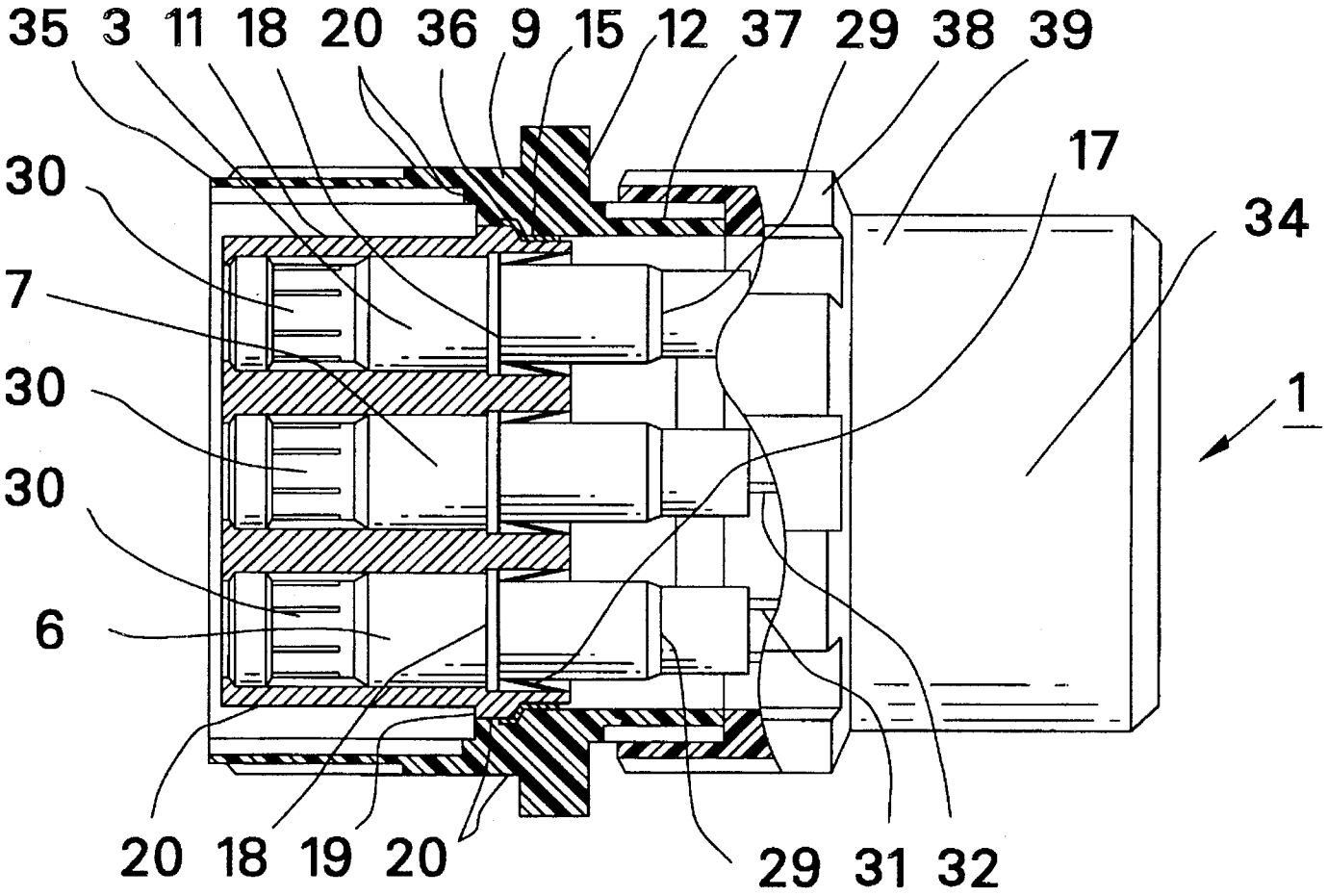
FIG. 1 is a side view, partially in cross section, showing a twinaxial data bus coupler connector arrangement according to a preferred embodiment of the invention.

FIG. 1 is a side view, partially in cross section, of a twinaxial data bus coupler connector 1 according to a preferred embodiment of the invention. Coupler 1 includes a plurality of standard twinaxial contact assemblies 2–7. The size and shape of the contacts may of course be varied as required, and it is intended that the invention be useable with contacts other than twinaxial contacts, such as triaxial contacts or coaxial contacts. The use of twinaxial contacts is by way of example only and not to be taken as limiting.

Figure 2:
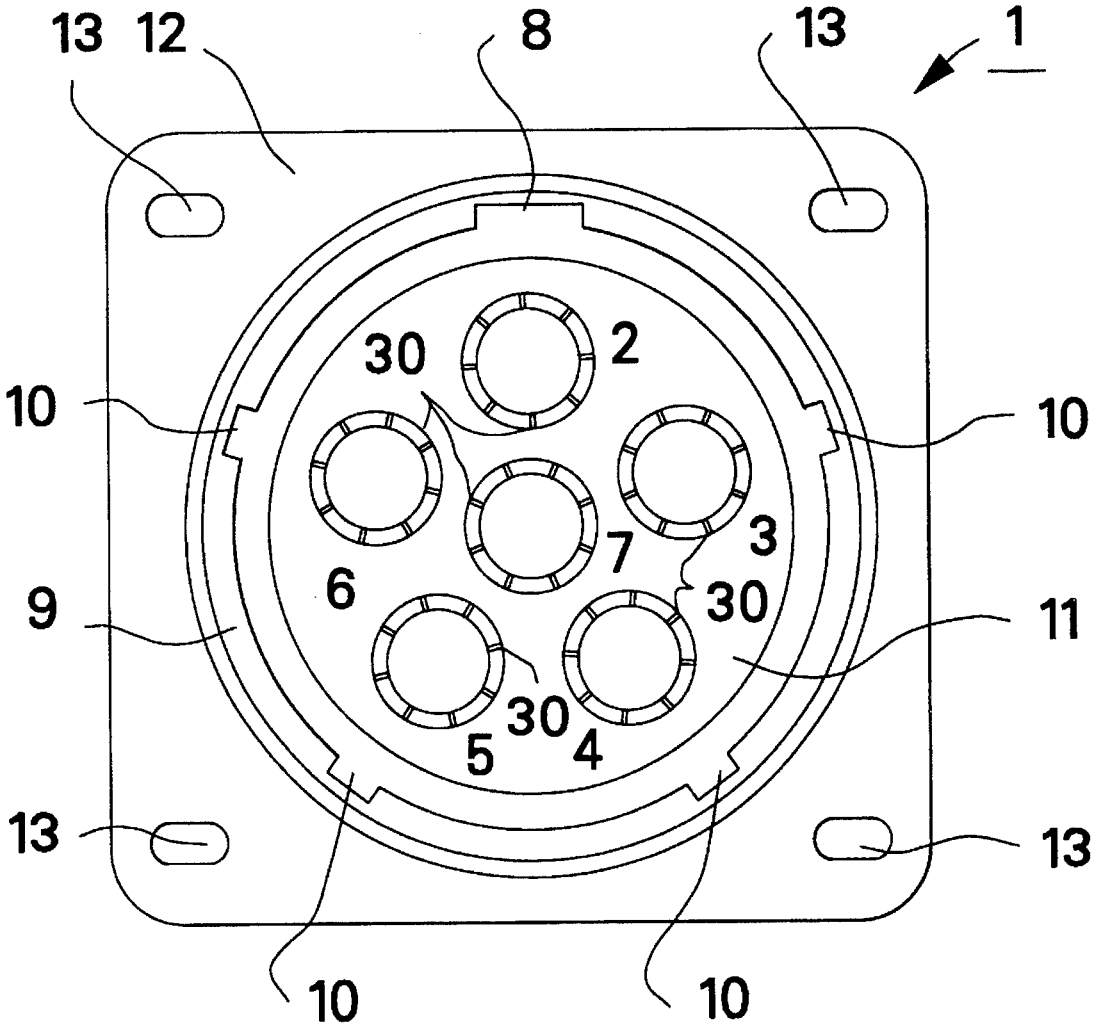
FIG. 2 is an end view of the data bus coupler connector of FIG. 1.
Figure 6:
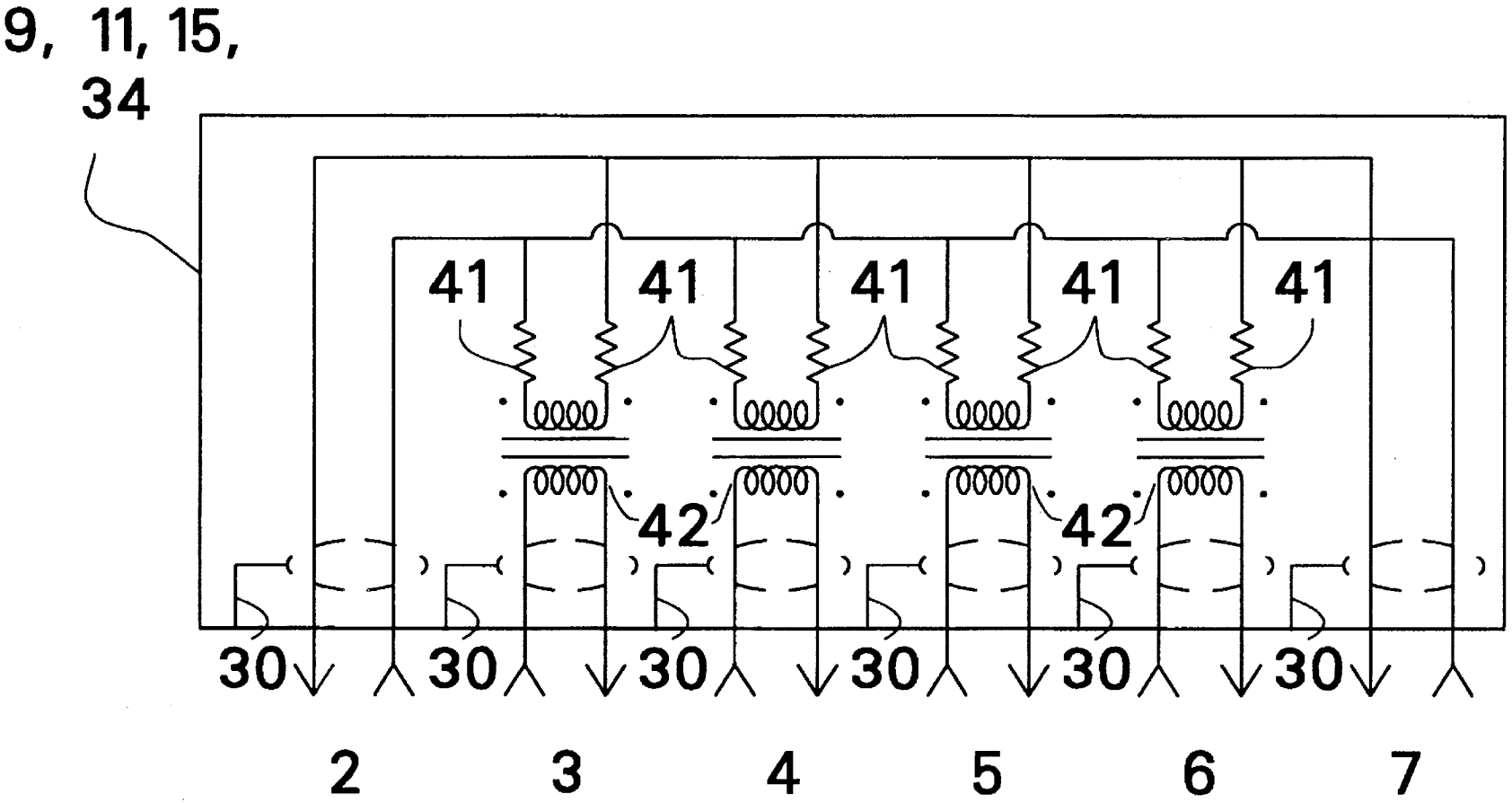
FIGS. 6 is a schematic wiring diagram for the data bus coupler connector of FIG. 1.

As shown in FIGS. 2 and 6, contacts 2 and 7 are arranged as main data bus contacts, while contacts 3–6 form stub contacts. While it is not critical that the contacts be arranged in any particular order, the illustrated version is convenient in that the main data bus contacts are easily identified because contact 7 is at the center of the coupler and contact 2 is adjacent an optional key 8 in the form of a groove on the inside of a cylindrical housing 9. Housing 9 shields contacts 2–7 and is also provided with grooves 10. Data bus contacts 2 and 7 are different from stub contacts 3–6 in that they are directly connected together by a bus line rather than connected via transformers, but the contacts are otherwise identical. The manner in which the contacts are connected together will be explained in greater detail below.

Figure 3B:
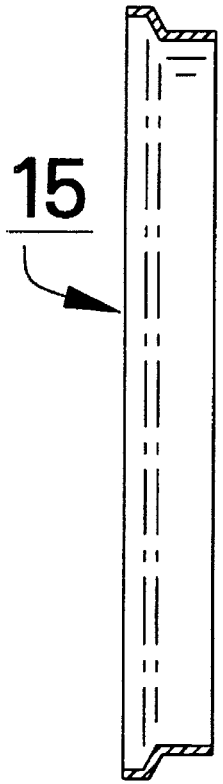
FIG. 3*b* is a conductive staking ring for use in the data bus coupler connector of FIG. 1.
Figure 3A:
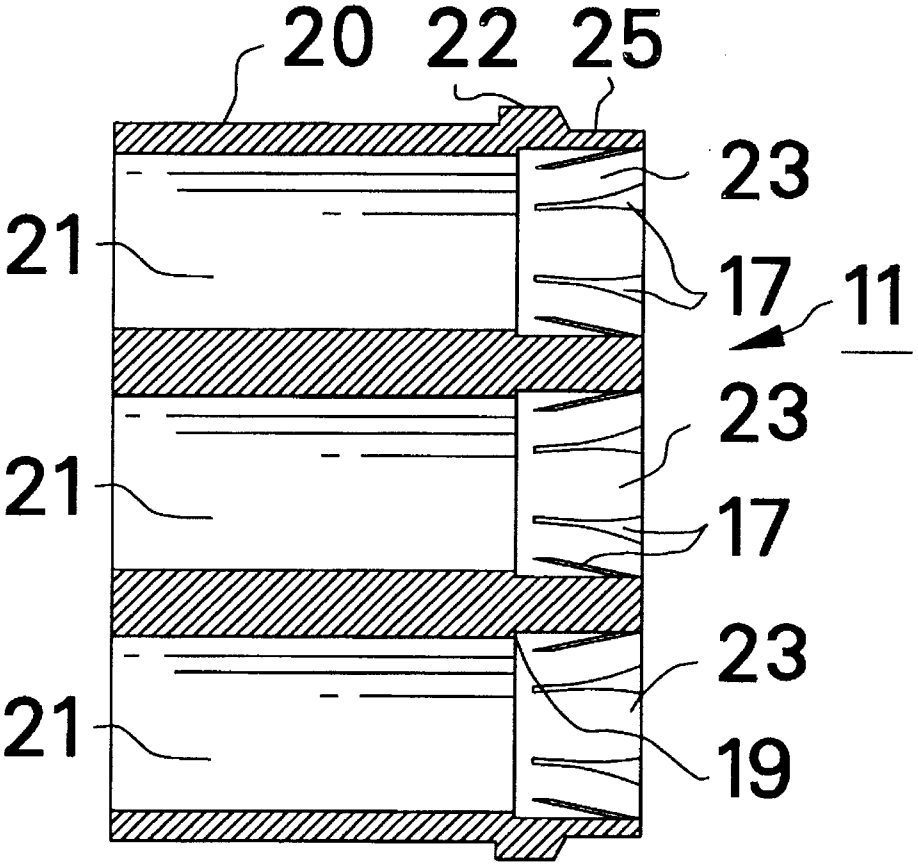
FIG. 3*a* is a cross-sectional side view of a conductive insert for use in the data bus coupler connector of FIG. 1.
Figure 5:
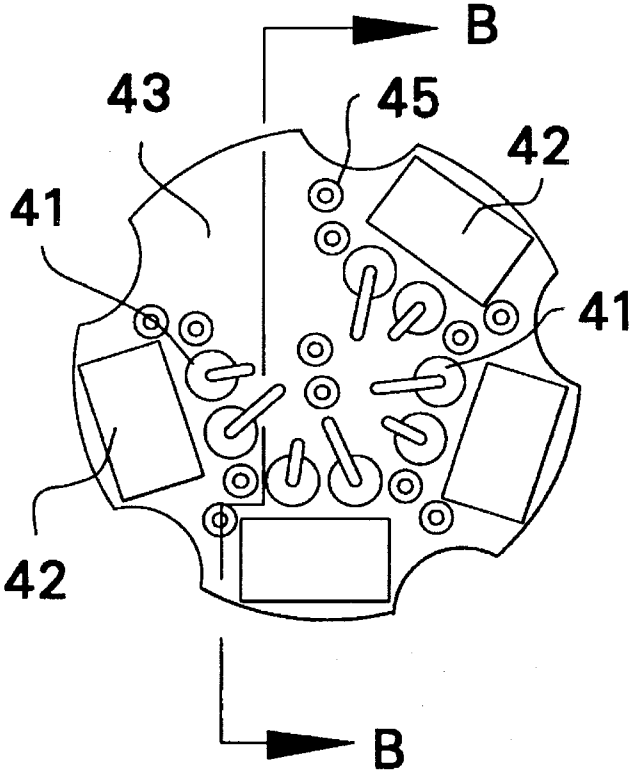
FIG. 5 is an end view of the circuit board of FIG. 4.

As is best shown in FIGS. 3(*a*)–3(*b*), contacts 2–7 are supported within housing 9 by conductive insert 11, which is held in place by conductive staking ring 15 and which serves to both retain the contacts within housing 9, and also provide a ground path between each of the contacts and the housing. Contact retention is accomplished by resilient retention fingers or tines 17 which are integral with and extend from retention clips mounted in apertures in conductive insert 11 and engage annular collars 18 provided on the contacts to retain the contacts within the assembly against steps or shoulders 19 and thereby prevent axial movement of the contact in either axial direction. It will be appreciated that resilient fingers 17 may be replaced by a wide variety of contact retention structures known to those skilled in the art, as required by the type of contact selected.

Conductive insert 11 may be formed of a solid conductive material or a conductively plated dielectric material. In either case, the insert is generally cylindrical and includes an aperture for each contact. A front section 20 of insert 11 has a smaller diameter and smaller apertures 21 than does a rear section 22. The larger diameter apertures 23 of section 20 are provided for the purpose of accommodating collars 18 and for forming shoulders 19. Conductive staking or retaining ring 15 fits over and is staked to a staking groove 25 on conductive insert 11, and to housing 9 in order to secure the resulting conductive insert assembly into the shell.

Contacts 2–7 include collars 18 and shoulders 19 utilized in the preferred embodiment for cooperation with tines 17 on conductive insert 11, and resilient contact tines 30 for establishing a secure electrical connection to the outer shield contact of a data bus or stub connection plug (not shown). As is conventional, the plugs also include signal carrying inner contacts (not shown) which mate with corresponding inner contacts on contacts 2–7 (not shown), the inner contacts of contacts 2–7 being connected to respective PC tails 31 and 32 on each contact.

Housing 9 and rear can enclosure 34 are preferably formed from a composite material such as polyetheretherketone (PEEK) reinforced with approximately 45% by weight carbon fibers. However, it is intended that the scope of the invention include other composite materials, including both inorganic and organic matrix composites, and other reinforcing fibers such as glass. For the purposes described herein, the term "composite material" is intended to mean any material that results when two or more materials, each having its own, usually different characteristics, are combined in order to provide the composite material with useful properties for a specific application, and in which each of the input materials serves a specific function in the composite. A significant advantage of organic matrix composites, such as the preferred 45% carbon fiber reinforced PEEK, is that the ratio of strength to weight is relatively high while manufacture can be accomplished by relatively simple molding techniques.

Housing 9 includes a front mating portion 35 for coupling to a corresponding plug connector to which the data bus and stub lines are secured, an intermediate section 36 to which insert 11 and conductive staking ring 15 are staked, and a rear section 37 provided with means such as external threads for securing rear can enclosure 34 to housing 9. A flange 12 provided with apertures 13 permits housing 9 to be secured to a bulkhead or electrical device housing by screws or the like (not shown) to mount the coupler and provide a direct path from the coupler housing to ground.

In order to provide shielding for the contents of the coupler, both coupler housing 9, insert 11 and rear can enclosure 34 are coated with a conductive metal such as nickel. A variety of suitable metals and coating methods are known to those skilled in the art, and each is intended to be included within the scope of the invention. However, it will be appreciated that, for maximum shielding effectiveness, metal plating 20 should cover all exposed interior and exterior surfaces of the housing and rear can enclosure, in order to provide 360° shielding and to ensure ground path continuity at flange 12 and at the interface between the housing, insert, 11 and conductive staking ring 15.

Figure 4:
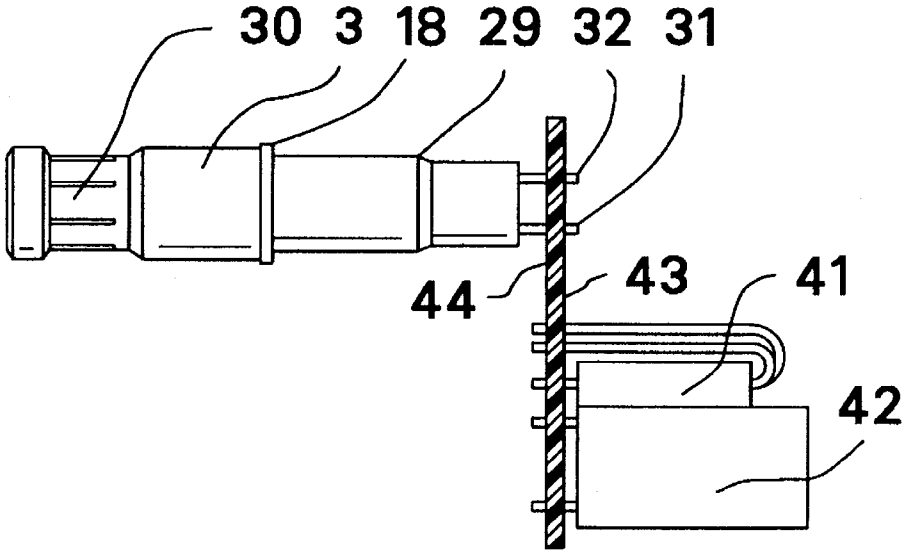
FIG. 4 is a cross-sectional side view of a printed circuit board, a representative twinaxial contact, and representative data bus circuitry arranged in accordance with the preferred embodiment of the invention, taken along line B—B of FIG. 5.

As is best shown in FIGS. 3 and 4, the preferred data bus coupler includes a circuit board assembly 43 having traces 44 connected to conductive tails 31 and 32 on contacts 2–7, and to a plurality of conventional resistors 41 and transformers 42 arranged according to the circuit shown in FIG. 6. The printed circuit board includes metal foil traces for directing the electrical paths and plated through-holes 45 for mounting and soldering in place the circuit components. Resistors 41 provide isolation for tapping into the bus lines via transformers 42. As is best shown in FIGS. 2 and 6, contacts 2 and 7 are located on the main bus line, and contacts 3–6 provide means for tapping into the bus line via the transformers.

Because PCB contact tails 31 and 32 terminate contacts 2–7 by being directly connected to through-holes 45 in circuit board 43, because all of the contacts extend from one side of the board and, because the board is consequently oriented transversely to longitudinal axes of the contacts, the length of the coupler is greatly decreased.

It will be appreciated, of course, that numerous contact arrangements and data bus or connector circuitry arrangements other than those described above could be used within the coupler of the preferred embodiment. In addition, the invention is not intended to be limited to data bus couplers, but rather may be applied to a wide variety of connector structures.

Finally, the features of a composite housing, conductive retention insert, and data bus PC board, while especially advantageous if used together, could also be provided separately in different contexts. For example, the 45% carbon fiber reinforced PEEK composite could also be used not only in cylindrical connector enclosures, but also in plug receptacles and connector coupling nuts. Therefore, while the invention has been described specifically in the context of a particular type of connector, it is intended that the invention not be limited thereto, but rather that it be limited only in accordance with the appended claims.

What is claimed is:

1. A shielded electrical connector, comprising electrical contact means for receiving a corresponding electrical contact connected to electrical signal carrying lines, wherein said connector includes a housing made of a composite material substrate and a conductive shield electrically connected to said contact means, wherein said composite material includes an organic composite matrix and reinforcing fibers, wherein said organic matrix is formed from polyetheretherketone (PEEK), wherein said reinforcing fibers are carbon fibers comprising approximately 45% by weight of said composite material, and wherein said conductive shield comprises metal plating on said substrate, and further comprising a conductive insert for electrically connecting said contact means to said conductive shield, wherein said conductive insert comprises contact retention means for retaining said contact means in said connector, and said retention means comprises a resilient finger extending from an aperture in said insert and adapted to engage a collar member extending from said contact means, thereby sandwiching said collar member between said finger, and a shoulder in said insert to prevent axial movement of said contact means.

2. A connector as claimed in claim 1, wherein said circuit board extends transversely in respect to principal longitudinal axes of said contact means.

3. A shielded electrical connector, comprising electrical contact means for receiving a corresponding electrical contact connected to electrical signal carrying lines, wherein said connector includes a housing made of a composite material substrate and a conductive shield electrically connected to said contact means, and further comprising a second one of said contact means and a printed circuit board for electrically connecting together said first and second contact means, wherein said contact means consists of contacts connected to said circuit board by PCB tails on said contacts such that said circuit board extends transversely in respect to principal longitudinal axes of said contact means and said contacts extend from only one side of said circuit board.

4. A connector as claimed in claim 3, wherein said first and second contact means are directly connected together and a third contact means is electrically connected to said first and second contact means via a transformer and isolation resistors.

5. A connector as claimed in claim 3, wherein said contact means are twinaxial contacts.

6. A shielded electrical connector, comprising shielding means for electrically shielding said connectors; contact means for inputting and outputting an electrical signal; and ground path means including a conductive insert member for electrically connecting said contact means and said shielding means, wherein said conductive insert member comprises retention means for retaining said contact means within said connector, and further comprising a second one of said contact means and a printed circuit board for electrically connecting together said first and second contact means, wherein said circuit board extends transversely in respect to principal longitudinal axes of said contacts, and wherein said contact means comprise twinaxial contacts terminated to said circuit board by PCB tails on said contacts.

7. A connector as claimed in claim 6, wherein said insert member comprises an aperture through which said contact means passes, means including a shoulder in said aperture for engaging said contact means and preventing axial movement of said contact means in a first direction, and means including a resilient tine extending into said aperture for engaging said contact means and preventing movement of said contact means in a direction opposite said first direction.

8. A connector as claimed in claim 6, wherein said connector comprises a housing and said shielding means comprises a metal plating on said housing.

9. A connector as claimed in claim 6, wherein said first and second contact means are directly connected together and a third contact means is electrically connected to said first and second contact means via a transformer and isolation resistors.

10. A connector as claimed in claim 6, wherein said circuit board extends transversely in respect to principal longitudinal axes of said contact means.

11. A connector as claimed in claim 6, wherein said housing comprises a substrate made of a composite material.

12. A connector as claimed in claim 11, wherein said composite material comprises a polyetheretherketone (PEEK) matrix and approximately 45% by weight carbon fibers.

* * * * *